US010611559B2

(12) United States Patent
Wang et al.

(10) Patent No.: US 10,611,559 B2
(45) Date of Patent: Apr. 7, 2020

(54) INNER CORNER CONNECTOR

(71) Applicants: Quingdao CIMC Reefer Trailer Co., Ltd., Qingdao (CN); CIMC Vehicles (Group) Co., Ltd., Qingdao (CN)

(72) Inventors: Xiaoyi Wang, Qingdao (CN); Xin'an Ding, Qingdao (CN); Renyong Xu, Qingdao (CN); Niancheng Zhou, Qingdao (CN); Baoyin He, Qingdao (CN); Guozhun Liu, Qingdao (CN); Xiaoming Su, Qingdao (CN)

(73) Assignee: Qingdao CIMC Reefer Trailer Co., Ltd., Qingdao (CN)

( * ) Notice: Subject to any disclaimer, the term of this patent is extended or adjusted under 35 U.S.C. 154(b) by 0 days.

(21) Appl. No.: 15/379,869

(22) Filed: Dec. 15, 2016

(65) Prior Publication Data

US 2018/0170665 A1 Jun. 21, 2018

(51) Int. Cl.
*B65D 90/08* (2006.01)

(52) U.S. Cl.
CPC ..... *B65D 90/08* (2013.01)

(58) Field of Classification Search
CPC ..... Y10T 403/54; Y10T 403/57; B65D 90/08; B65D 88/74; F16J 15/02; F16J 15/022; F16J 15/025
USPC ..... 296/29, 186.1; 49/484.1, 479.1, 495.1; 277/921
See application file for complete search history.

(56) References Cited

U.S. PATENT DOCUMENTS

| | | | | |
|---|---|---|---|---|
| 3,065,019 | A | 11/1962 | May | 296/173 |
| 3,378,958 | A * | 4/1968 | Parks | E06B 7/231 49/489.1 |
| 5,041,318 | A | 8/1991 | Hulls | 428/57 |
| 5,143,416 | A | 9/1992 | Karapetian | 296/29 |
| 5,218,792 | A | 6/1993 | Cooper | 52/46 |
| 5,320,403 | A | 6/1994 | Kazyak | 296/203.01 |
| 5,431,475 | A | 7/1995 | Perry | 296/183.1 |
| 5,472,290 | A | 12/1995 | Hulls | 403/393 |
| 5,741,042 | A | 4/1998 | Livingston | 296/203.01 |
| 6,688,674 | B2 | 2/2004 | Sato | 296/185.1 |
| 7,494,177 | B2 | 2/2009 | Henning | 296/186.1 |
| 7,862,101 | B2 | 1/2011 | Lusk | 296/178 |
| 7,993,719 | B2 | 8/2011 | Stanton | 428/57 |
| 8,177,290 | B2 | 5/2012 | Kamimae | 296/190.08 |
| 8,261,501 | B2 | 9/2012 | Huang | 52/277 |
| 8,333,419 | B2 | 12/2012 | Huang | 296/29 |

(Continued)

FOREIGN PATENT DOCUMENTS

CA 2764793 A1 * 7/2012 ..... E04F 11/1853

*Primary Examiner* — Allan D Stevens
(74) *Attorney, Agent, or Firm* — Niro McAndrews, LLP

(57) ABSTRACT

Disclosed is an improved inner corner connector adapted to be secured at the intersections of container panels, such as walls, floors, and roofs. The inner corner connector includes a substantially horizontal base section with at least two substantially rigid flanges extending downward from the base section. The flanges are substantially parallel to each other and are spaced such that the resilient inner plate of a first panel snuggly fits between the two flanges. Extending upwards from the horizontal base are at least two flexible flaps that are configured to press against the inner plate of a second panel to create a thermal and moisture barrier at the intersection of the two panels.

18 Claims, 6 Drawing Sheets

(56) References Cited

U.S. PATENT DOCUMENTS

| | | | | |
|---|---|---|---|---|
| 8,657,363 | B1 * | 2/2014 | Roush | B60P 3/20 296/186.1 |
| 2011/0220030 | A1 * | 9/2011 | Akyuz | A01K 1/0107 119/165 |
| 2011/0318094 | A1 * | 12/2011 | Hensley | E06B 3/26305 403/217 |
| 2015/0151716 | A1 * | 6/2015 | Polocoser | B60S 1/3889 15/250.201 |
| 2015/0266364 | A1 * | 9/2015 | Im | B60J 10/76 49/495.1 |
| 2017/0248900 | A1 * | 8/2017 | Yoshitsugu | G03G 21/1633 |

* cited by examiner

INNER CORNER CONNECTOR

FIELD OF THE INVENTION

The present invention relates generally to insulation for an over-the-road cargo container, and more particularly to a deformable insulative piece for sealing joints between panels of a container.

BACKGROUND OF THE INVENTION

Insulated shipping containers such as those used in over-the-road, rail, and ocean going containers often include panels (walls, roofs, and floors) formed from inner plates, outer plates, and foaming heat preservation layers between the plates. While the walls act as a substantial thermal and vapor barrier, the connections between the panels may provide gaps or cracks through which heat and vapor may pass.

In some instances a wall panel is connected to the roof panel via a piece of metal that is secured to both the upper portion of the wall panel and the side of the roof panel. Often, the metal sheet will be secured to the panels via blind rivets, however, since there are gaps at the rivets, and the rivet mandrel may not properly seal, it is easy for water vapor in the container body to invade into the heat preservation layer via the gaps at the rivets or the rivet mandrel. Any gaps between the panels reduce the effect of the heat preservation layer. In addition, in this traditional connecting manner, the connector is secured to the inner side panel and the inner roof sheet in a hard mechanical manner that does not compensate for flexure that may occur during transport of the container.

During loading or unloading of the cargo from the container, the metal piece securing the wall panel to the roof panel may deform based on the flexure of the roof panel, side panel, or floor panel. Over time, further flexure may act to diminish the sealing properties of the metal piece. In addition to issues associated with the gradual degradation of the sealing piece, the installation of metal pieces between the roof panel and the wall panel often requires specialized clamping tools as well as rivets.

SUMMARY OF THE INVENTION

Disclosed is an improved inner corner connector adapted to be secured at the intersections of container panels, such as walls, floors, and roofs. The inner corner connector includes a substantially horizontal base section with at least two substantially rigid flanges extending downward from the base section. The flanges are substantially parallel to each other and are spaced such that the resilient inner plate of a first panel snuggly fits between the two flanges. Extending upwards from the horizontal base are at least two flexible flaps that are configured to press against the inner plate of a second panel to create a thermal and moisture barrier at the intersection of the two panels. More than two flaps may be utilized to improve the quality of the thermal barrier, and the upper portions of the flaps may be joined together such that two flaps define an enclosed area.

DETAILED DESCRIPTION

The present invention may be used in association with any insulated structure, however for the purposes of this application, the invention will be primarily described in association with an insulated over-the-road trailer.

Figure 1:
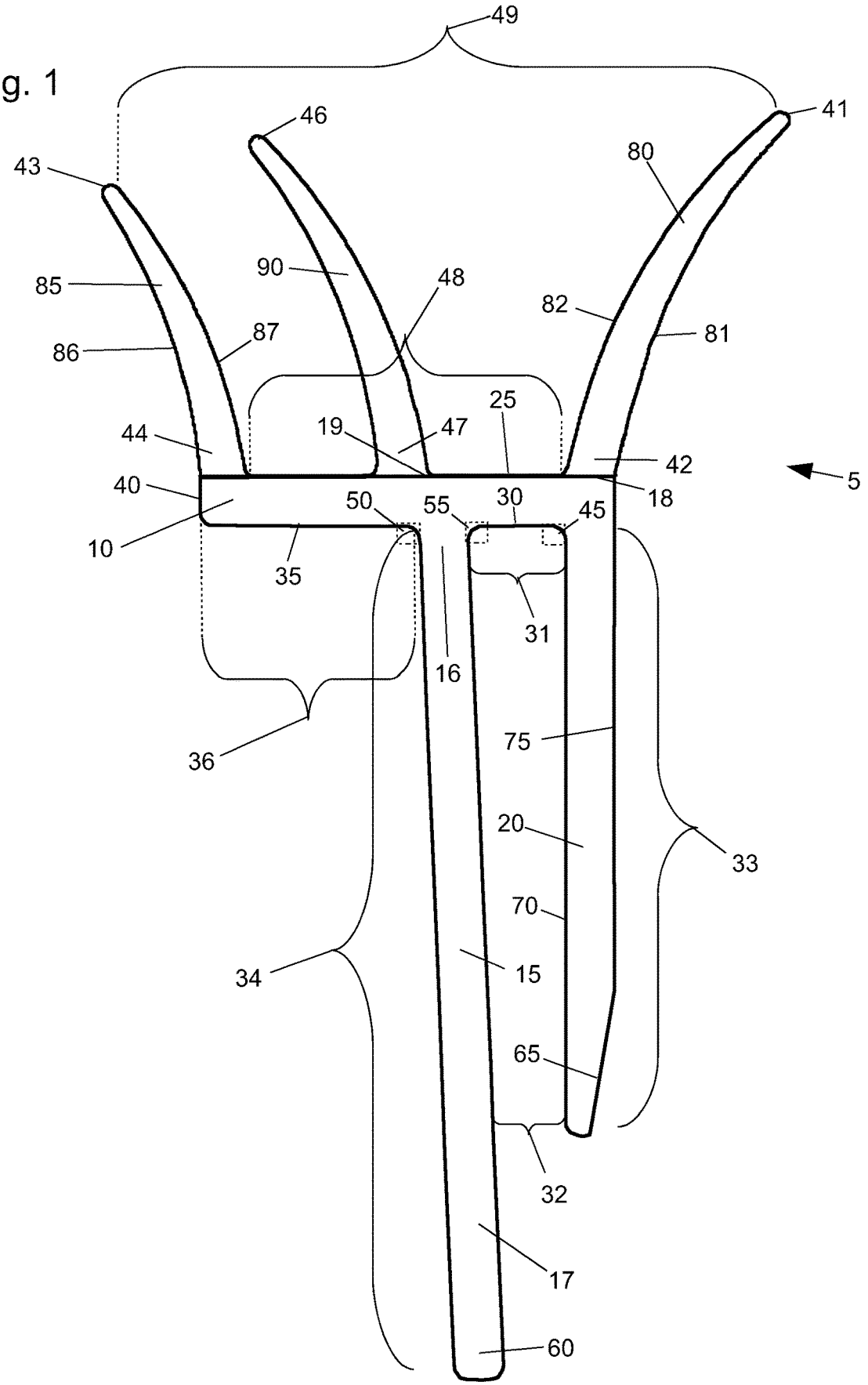
FIG. 1 shows a cross section of an inner corner connector illustrating a three flap connector in an uninstalled state.

FIG. 1 shows a cross section of an inner corner connector 5 having a horizontal base 10 with a center flange 15 and an inner flange 20 extending down from a first side of the horizontal base 10. The illustrated horizontal base 10 includes a substantially flat top 25 (or second side) from which flaps extend upwards. While the illustrated inner corner connector 5 has a flat top, it should be appreciated that in alternate embodiments the top will be textured, rounded, or include various coatings. For example, in one embodiment additional insulation is added between the flaps and the top of the horizontal base is highly textured to help the foam stick to the inner top. In yet another embodiment, a low friction coating, such as polytetrafluoroethylene, is added to a portion of the flat top between two flaps that have been secured together at their tops. The coating allows spray foam or other insulation to be easily slid down the length of the cavity formed by the two flaps (over 50 feet in certain embodiments).

A first substantially flat bottom 30 is located on the underside of the horizontal base 10 between the center flange 15 and the inner flange 20. A second substantially flat bottom 35 is located between the center flange 15 and the outer side 40 of the horizontal base 10. The first substantially flat bottom 30 between the two flanges is configured to abut a resilient plate on the inner surface of a panel. The first substantially flat bottom 30, the inner flange 20, and the center flange 15 cooperate to form a cavity in which an inner plate of a panel is secured. While the illustrated first substantially flat bottom 30 is flat, in alternate embodiments the first substantially flat bottom 30 between the two flanges may include features that match the contours or shape of the inner plate of the panel. Alternatively, padding may be added below the first substantially flat bottom 30 to prevent the inner corner connector 5 from being damaged if the connector is pressed down upon the inner plate of the panel with excessive force.

Extending from the center flange 15 to the outer side 40 of the horizontal base 10 is the second substantially flat bottom 35, such that the center flange 15 is separated from the outer side 40 by a fifth distance 36. While the first substantially flat bottom 30 is configured to abut a resilient plate of a panel, the second substantially flat bottom 35 is configured to abut the foam or insulation sandwiched between two plates. In the illustrated example, the second substantially flat bottom 35 is approximately twice the size of the first substantially flat bottom 30, however in alternate embodiments, the size ratio between the first and second substantially flat bottoms will be at least 1:3 or 1:4. By increasing the size of the second substantially flat bottom 35 relative to the first substantially flat bottom 30, the amount of support provided by the second substantially flat bottom 35 to prevent outward rotation of the inner corner connector 5 is increased such that the sizes of the center and inner flanges (15, 20) may be decreased. Increasing the size of the second substantially flat bottom 35 will also be useful if a thinner or less resilient plates are utilized in the panels of the cargo container.

In the illustrated example of FIG. 1, the center flange 15 extends downward from the horizontal base 10 approximately 35 millimeters, and has a thickness of approximately 2 millimeters which is also the approximate thickness of the horizontal base 10 and the inner flange 20. The dimensions listed in this example are exemplary and it should be appreciated that the use of smaller and/or larger dimensions are within the scope of the invention. As an example, a larger inner corner connector may be utilized for larger containers or for containers with large amounts of insulation between panel plates. Additionally, relative sizes of the components of the inner corner connector may be varied. For example, in FIG. 1, the center flange 15 extends down from the horizontal base 10 approximately 35 millimeters while the inner flange 20 only extends down 25 millimeters from the horizontal base 10. In alternate embodiments, the downward lengths of the center and inner flanges are equal, and in yet another embodiment the inner flange extends down a distance greater than the center flange. Having a longer inner flange may be particularly useful in situations where the inner plate of the wall panel has a bowed or flawed top surface. Additionally, a longer inner flange may be useful in covering cosmetic blemishes that could occur at the edges of the panel during the manufacturing process similar to the way crown molding may be utilized to mask blemishes at the wall/ceiling interfaces of buildings.

In FIG. 1, the center and inner flanges (15, 20) extend down from the horizontal base in a slightly skew (almost parallel) orientation. While the inner flange 20 forms a right angle 45 with the first substantially flat bottom 30, the center flange 15 forms a slightly obtuse angle 50 with the second substantially flat bottom 35 and an acute angle with the first substantially flat bottom 30. In a first embodiment, the obtuse angle 50 is between 90 and 100 degrees with the acute angle 55 between 80 and 90 degrees. In a second embodiment, the obtuse angle 50 is between 91 degrees and 95 degrees with the acute angle 55 between 85 and 89 degrees. In a third exemplary embodiment, the obtuse angle 50 is 92 degrees and the acute angle 55 is 88 degrees. Based on the angle of the center flange 15, proximal portions 16 of the center flange 15 that are proximal to the horizontal base 10 are a further distance from the inner flange 20 than the separation distance of distal portions 17 of the center flange 15 that are distal to the horizontal base 10. The proximal portions 16 of the center flange 15 are a first distance 31 from the inner flange 20, and the distal tapered end 65 of the inner flange 20 is a second distance 32 from the center flange 15. The first distance 31 is less than the second distance 32. The distal tapered end 65 is a third distance 33 from the horizontal base 10, and the distal foot region 60 of the center flange 15 is a fourth distance 34 from the horizontal base 10. The fourth distance 34 is greater than the third distance 33.

By having the center flange 15 angle towards the inner flange 20, when the inner corner connector 5 is placed on to the top of a container panel, the inner flange 20 will be substantially parallel to the inner plate of the panel while the foot region 60 of the center flange 15 will deflect off the inner plate. Based on the flexibility of the center flange, the center flange will press against the inner plate with a varying degree of force that will act to secure the inner corner connector on to the panel.

While the center flange 15 of FIG. 1 has a foot region 60 that is substantially rectangular, it should be appreciated that various features may be incorporated into the foot region 60 to customize the inner corner connector for varying uses. For example, in some embodiments, the inner corner connector will be utilized with panels having resilient insulation tightly bound between the inner and outer plates. To facilitate installation of inner corner connectors for these types of panels, the cross section of the foot region 60 may be tapered to a sharp point for easy insertion. In an alternate embodiment, the foot region includes a convex structure that is adapted to fit into a concave groove formed on the inner plate of the panel. By including complimentary locking features on the center flange and the inner plate of the panel, the connection between the inner corner cover and the panel may be made more secure. In addition to incorporating concave/convex structures into the flange/plate, other matching structures may be utilized. For example, apertures may extend through the center flange while the inner plate includes protrusions shaped to fit through the apertures. Alternatively, complimentary ratcheting surfaces may be included on the flange and plate such that the inner corner connector may be easily installed on a panel while removal would be quite difficult.

The inner flange 20 shown in FIG. 1 extends perpendicularly down from the horizontal base approximately 25 millimeters and includes a distal tapered end 65 between an outer side 70 and an inner side 75. The illustrated outer side 70 is smooth such that the inner flange 20 may be easily slid over the inner plate of the panel. The inner flange 20 includes a distal tapered end 65 that acts to reduce the number of sharp edges on the interior of the cargo container. Additionally, by tapering the lower end the numbered of potential snag points may be reduced. While most of the tapering of the distal tapered end 65 is show adjacent to the inner side 75 of the inner flange 20, a slight amount of tapering occurs adjacent to the outer side 70. While the tapering adjacent to the inner side 75 acts to improve the inner surface of the cargo container, a slight amount of tapering adjacent to the outer side acts to facilitate installation of the center and inner flanges (15, 20) around the inner plate of a wall panel. If the tapered portion adjacent to the outer side 70 (or surface) is pressed down upon the inner plate of the panel, the tapering will act to move the inner corner connector inward such that the plate and connector are aligned for easy installation.

While the outer side 70 of the inner flange 20 is generally smooth, the inner side 75 of the inner flange 20 may be smooth or it may include textures or features. For example, in one embodiment the inner side 75 includes a plurality of latches or rings such that the inner corner connector may be utilized as a tie down location within the cargo container. In an alternate embodiment, the inner side 75 of the inner flange 20 is concave such that the apparent transition between perpendicular panels is slightly rounded. In yet another embodiment, in addition to having a concave inner side 75, a concave protrusion extends upward from the inner side 75 past the horizontal base 10 to a region adjacent to the upper panel. In addition to providing a refined smooth transition between panels, the addition of a concave protrusion up towards the upper panel may act to help protect the flaps of the inner corner cover 5 when the cargo container is loaded and unloaded because the flaps may be constructed of a material that is more flexible, but less resilient, than the materials that form the horizontal base and the flanges.

In the embodiment shown in FIG. 1, an inner flap 80 extends upward approximately 15 millimeters to a first distal end 41 from a first proximal end 42 at a first attachment point 18 on the horizontal base 10 approximately adjacent to the inner side 75 of the inner flange 20. An outer flap 85 extends upward to a second distal end 43 from a second proximal end 44 at the horizontal base 10 adjacent to the outer side 40, and a middle flap 90 extends upward to a third distal end 46 from a third proximal end 47 at a second attachment point 19 on the horizontal base between the inner and outer flaps (80, 85). The second proximal end 44 is separated from the first proximal end 42 by a first separation 48 while the second distal end 43 is separated from the first distal end 41 by a second separation 49. The flaps are preferably constructed from flexible materials such that they may be repeatedly deformed and pressed against another panel. By pressing against a second panel, the flaps (80, 85, 90) act to form a vapor and heat barrier at the intersection of the two panels. Since the flaps are flexible, the inner corner connector 5 will continue to maintain a thermal barrier even if the two panels shift, rotate, or flex relative to each other during the transport of the cargo container.

The inner flap 80 includes a first concave surface 81 that is opposite to a first convex surface 82. The outer flap 85 also includes a second concave surface 86 that is opposite a second convex surface 87. In the illustrated example, the two convex surfaces (82, 87) are located directly between the two concave surfaces (81, 86).

In one embodiment of the invention, the entire inner corner connector 5 is constructed from a single continuous piece of plastic material such as polyvinyl chloride (PVC). In an exemplary embodiment, additional plasticizers, such as phthalates, have been added to the PVC forming the flaps (80, 85, 90) so that the flaps are flexible while the horizontal base 10 and flanges (15, 20) are rigid. In one embodiment, the concentration of plasticizers in the flaps is substantially higher than the concentration of plasticizers in the horizontal base, the inner flange, and the center flange.

In the illustrated example shown in FIG. 1, there are three flaps and the inner flap 80 extends inward while the outer and middle flaps (85, 90) extend outwards. However, it should be appreciated that more or fewer flaps may be utilized and varying curvatures of flaps may also be used. For example, in a first embodiment, the inner corner connector includes only an inner and outer flap, and both flaps curve outwards. In a second embodiment, the four flaps are utilized and the inner three flaps curve inward while the outer flap curves outward.

Due to the possibility of the flexure of one flap interfering with the flexure of another flap, it is generally expected that most embodiments will include a certain number of innermost flaps curving inward, and a certain number of outermost flaps curving outward. If an inner flap curves outward while an outer flap curves inward, additional features may be added to prevent one flap from interfering with the flexure of another flap when the inner corner connector is pressed against a second panel. For example, in one embodiment, the tops of an inner flap and an outer flap are secured together into a half-circle shape such that compression of the flaps will cause a predictable flattening of the half circle. In an alternate embodiment, the upper ends of the flaps include a low resistance coating, such as polytetrafluoroethylene, and the upper ends are tapered such that the two flaps will slide past each other when the inner corner connector is compressed. In one embodiment with an inner flap curving outward and an outer flap curving inward, the inner flap has a tip with a tapering on the lower side of the tip while the outer flap has a tapering on the upper side of the tip. When the two flaps are compressed, the inner flap will predictably slide above the outer flap based upon the tapering of the tips.

Figure 2:
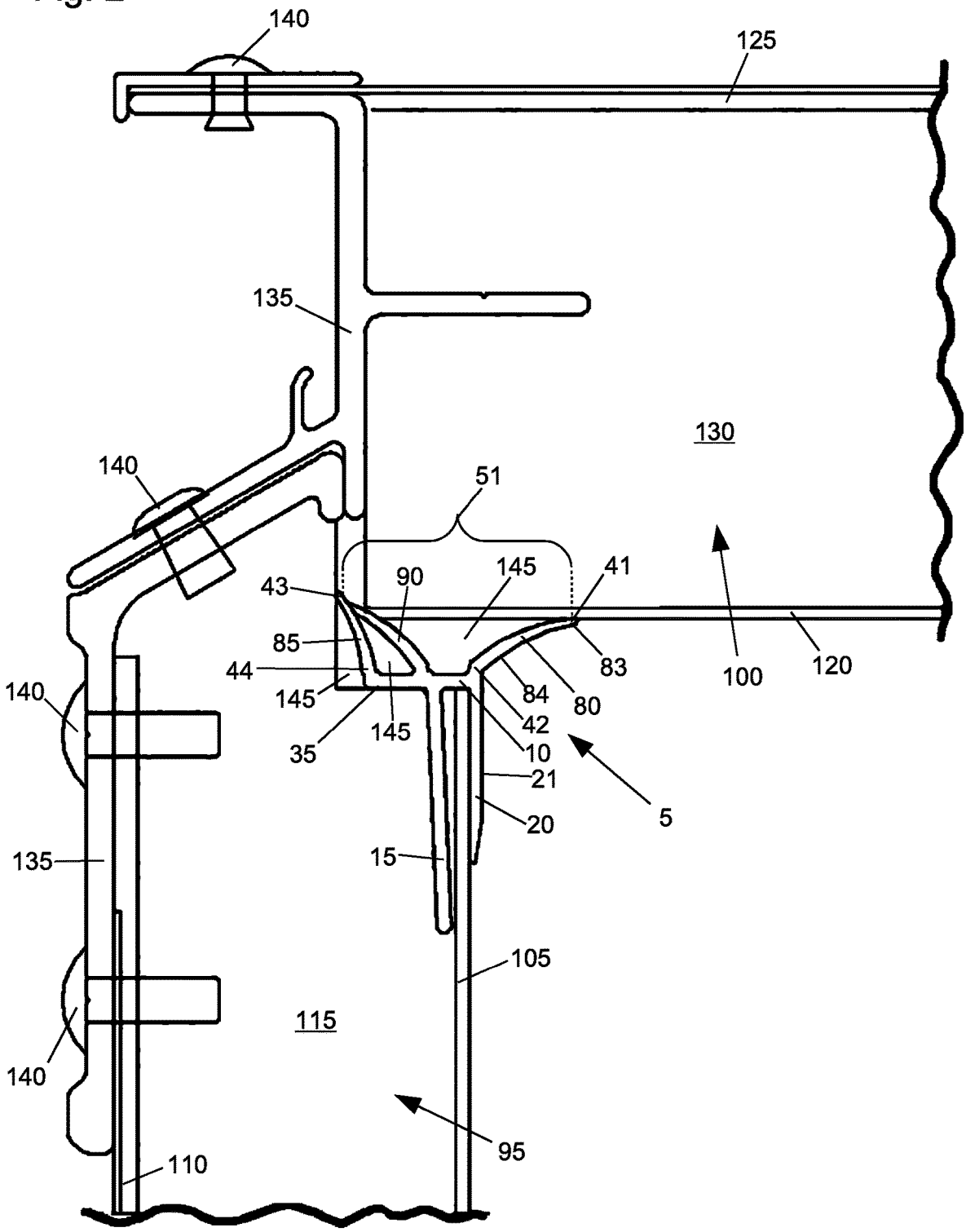
FIG. 2 shows a cross section of an inner corner connector in an installed state with three flaps sealing a joint between a wall panel and a roof panel.

FIG. 2 illustrates an inner corner connector 5 secured between the end of a first panel 95 and the end of a second panel 100. The first panel 95 includes a first inner plate 105, a first outer plate 110, and first insulative material 115 between the first inner plate 105 and the first outer plate 110. The second panel 100 includes a second inner plate 120, a second outer plate 125, and a second insulative material 130 between the second inner plate 120 and the second outer plate 125. Fasteners 135 are secured to the outer plates (110, 125) of the panels via rivets 140 and act to lock the panels (95, 100) into a locked perpendicular relationship. In the illustrated example, the center flange 15 and the inner flange 20 of the inner corner connector 5 act to flank or surround the upper portion of the first inner plate 105.

FIG. 2 also illustrates an inner corner connector 5 having an inner flap 80, an outer flap 85, and a middle flap 90, wherein the inner flap 80 and the middle flap 90 are bent substantially more than the outer flap 85. The first and second proximal ends (42, 44) of the flaps are separated by the first separation 48 while the first and second distal ends (41, 43) of the flaps are separated by a third separation 51 that is greater than the second separation 49. FIG. 2 also illustrates that in some embodiments of the invention not all of the flaps will be pressed and bent against a panel. The illustrated example also illustrates the numerous independent air spaces 145 formed or defined by the inner corner connector 5 between the first panel 95 and the second panel. By forming numerous independent air spaces 145, the inner corner connector is able to mimic the insulative properties of open cell foam which also has numerous independent air spaces. Open cell foam typically has an R-value of approximately 3.5 to 4.0 per inch, so a similar R-value may be obtainable through the use of the inner corner connector. To further increase the insulative properties of the inner corner connector, auxiliary flaps may be secured between the main flaps (80, 85, 90) along the length of the inner corner connector 5 in such a way that numerous independent air spaces are created between each of the main flaps (80, 85, 90). In yet another embodiment, an additional flap is located between the inner flap 80 and the middle flap 90. The additional flap, the inner flap 80, the second inner plate 120, and the horizontal base 10 define a first independent air space. The additional flap, the middle flap 90, the second inner plate 120, and the horizontal base 10 define a second independent air space.

In FIG. 2, a first surface portion 83 of the inner flap 80 is adjacent to, and is parallel to the second inner plate 120. The inner flange 20 has a second surface portion 21 that is adjacent to and parallel with the first inner plate. Between the base 10 and the first surface portion 83, the inner flap 80 includes a concave surface portion 84. FIG. 2 also illustrates substantially all of the second substantially flat bottom 35 surface directly abutting the first insulative material 115.

Figure 3:
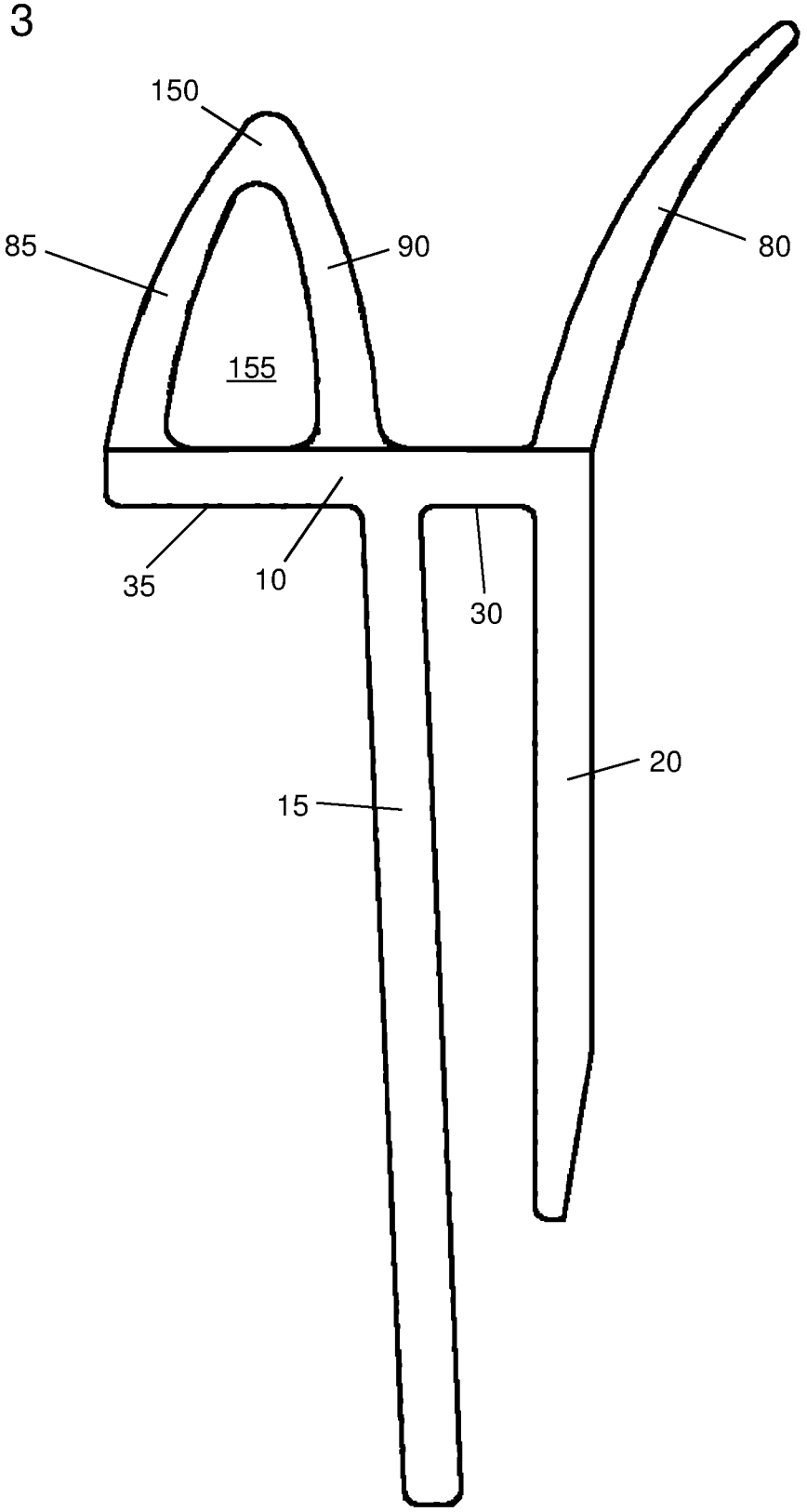
FIG. 3 shows a cross section of a three flap inner corner connector having two flaps secured together to define an interior space.

FIG. 3 illustrates an embodiment of an inner corner connector wherein the tops 150 of the outer flap 85 and the middle flap 90 have been secured together to form a semicircular structure and an enclosed space 155. By forming a deformable enclosed structure, the air flow around the flaps may be further decreased. Additionally, the formation of a closed structure or area in the inner corner connector allows for advanced insulative materials to be added in the closed area during the manufacture of the inner corner connector.

For example, the inventors contemplate that advanced aerogels (with R-values up to R-20 per inch) may be added to the enclosed areas to further improve the insulative properties of the inner corner connector.

Figure 4:
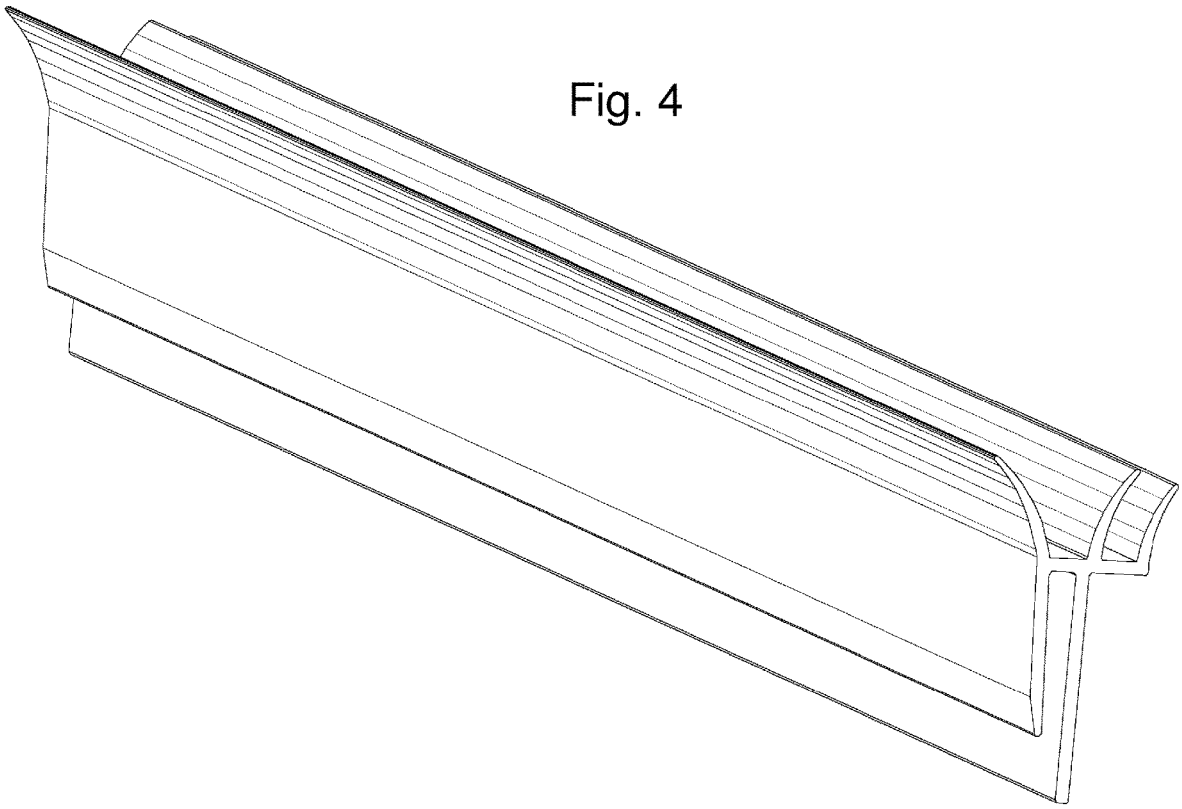
FIG. 4 shows a first perspective view of the inner corner connector of FIG. 1.
Figure 5:
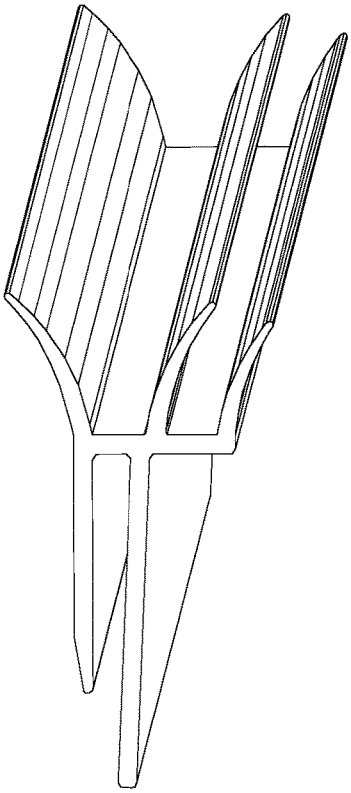
FIG. 5 shows a second perspective view of the inner corner connector of FIG. 1.

FIGS. 4 and 5 illustrate perspective views of an inner corner connector 5. The inventors contemplate that the inner corner connector will generally have a length that is substantially greater than its width or height. In one embodiment, the inner corner connector has a total height of approximately 2 inches, a width of approximately and inch, and a length of approximately 50 feet (the length of an over-the-road trailer). In another embodiment, the inner corner connector has a length of approximately 110 inches and insulates the joint between a sidewall of an over-the-road trailer and the front wall of the trailer. In a third embodiment, the inner corner connector has a length of 101 inches and insulates the joint between the roof of an over-the-road trailer and the front wall.

Figure 6:
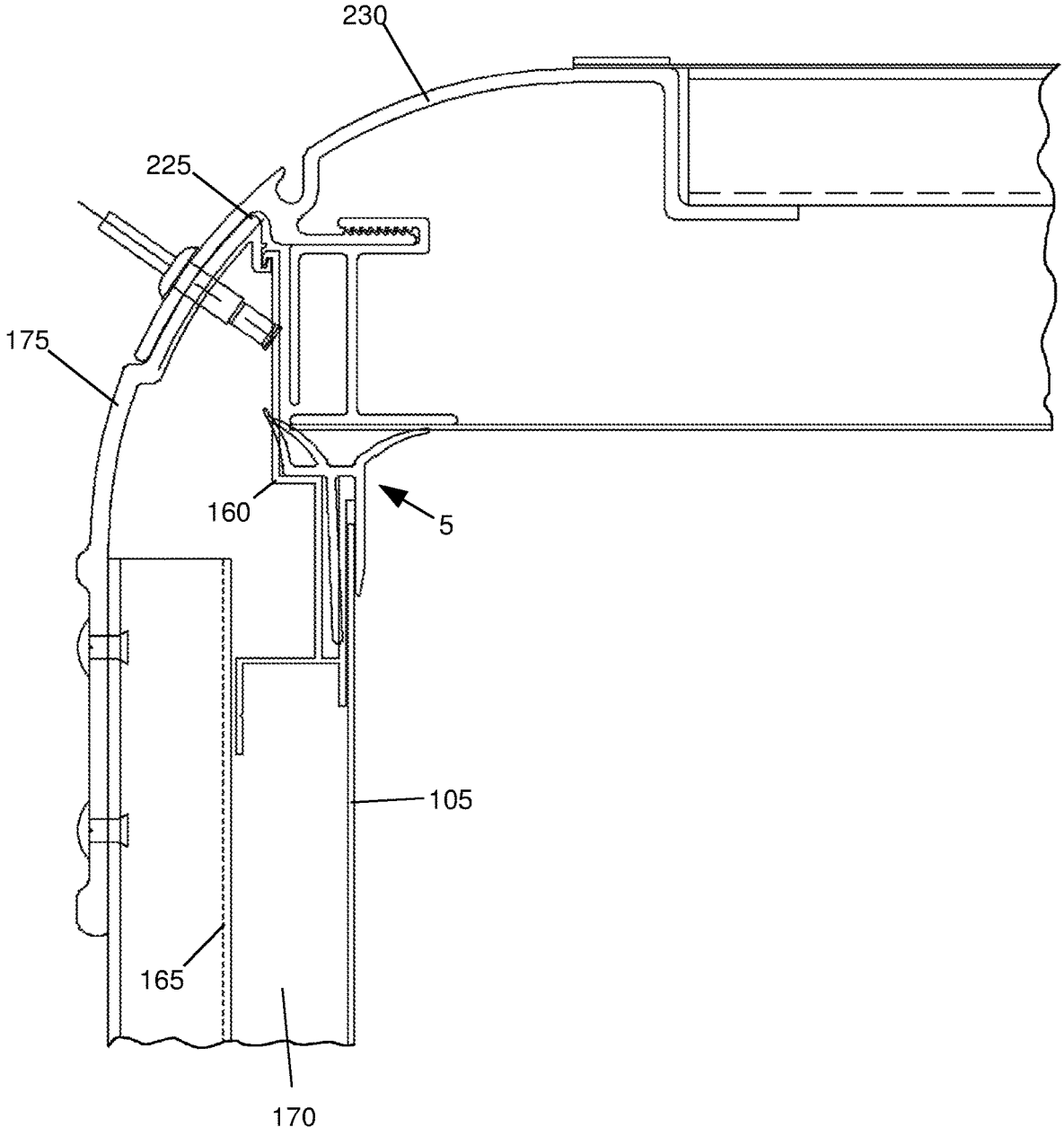
FIG. 6 shows a cross section of an inner corner connector secured to a bracket configured to form a foaming cavity.

FIG. 6 shows a side cross sectional view of an inner corner connector 5 with flanges secured around both a first inner plate 105 and a bracket 160 configured to cooperate with stringers 165 to form a foaming cavity 170 within the sidewall of the cargo container. The structures forming the foaming cavity 170 are constructed of resilient materials that are able to contain the expansion of foam applied within the foaming cavity 170. In one embodiment, the bracket is constructed of PVC and the foaming material includes isocyanate and polyol resin. The bracket 160 includes attachment features that allow it to be secured to both the first inner plate 105 and the top side rail 175 before insulative foam has been applied to the foaming cavity 170. After the insulative foam has been applied to the foaming cavity, the attachment features continue to secure the bracket 160 to the first inner plate 105 and the top side rail 175, but the expanded foam also acts to the secure the bracket 160 in position.

Figure 7:
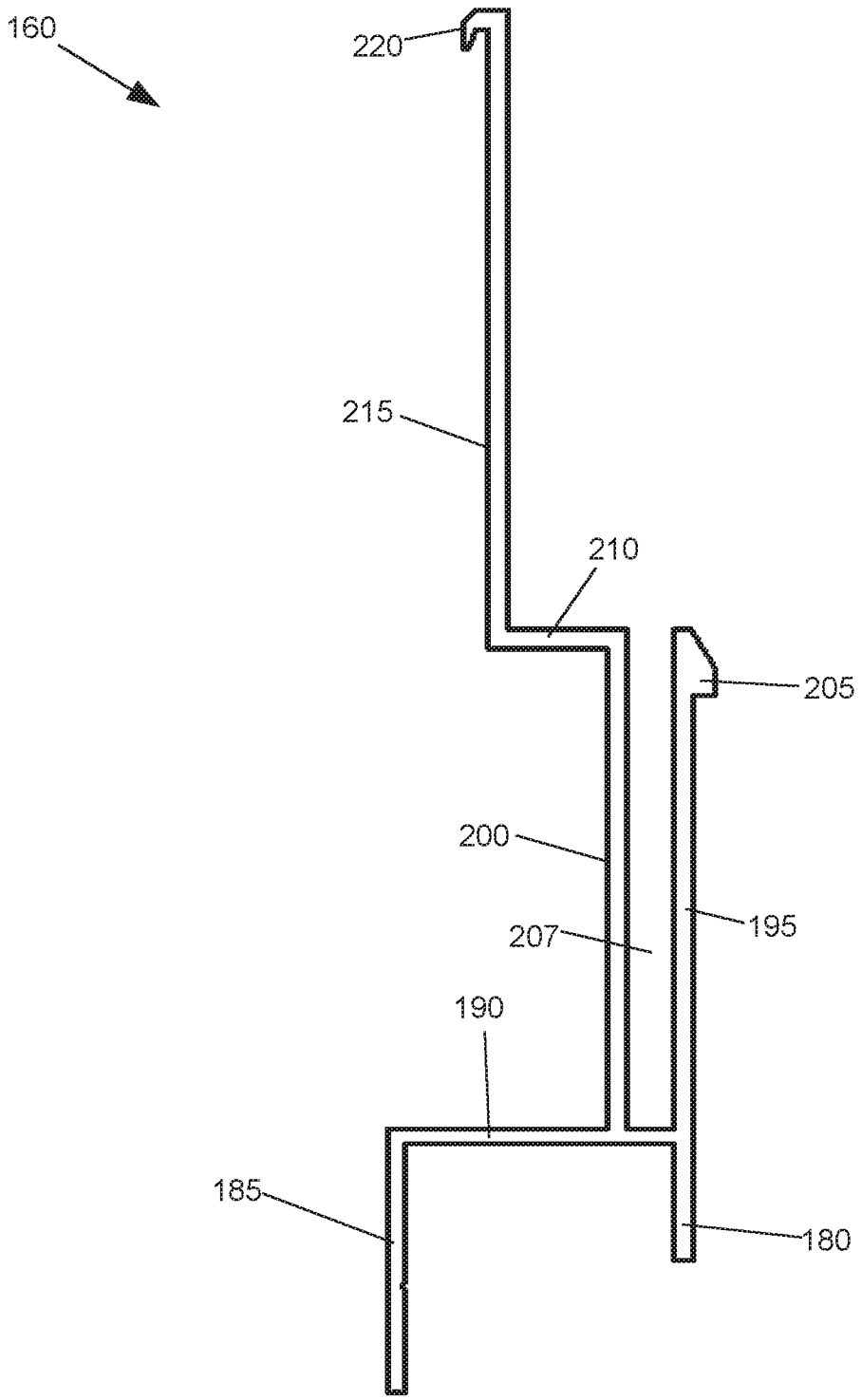
FIG. 7 shows an isolated view of the bracket of FIG. 6.

FIG. 7 shows an isolated view of the bracket 160 of FIG. 6. The bracket 160 includes an inner foam slat 180 and an outer foam slat 185 located at the lower region of the bracket 160. The inner and outer foam slats (180, 185) extend between a horizontal foundation 190. The foam slats (180, 185) are configured to receive expanding foam and generally resist the further expansion of the foam. The expansion of the foam against the foam slats (180, 185) acts to lock the bracket 160 into position. Extending up from the horizontal foundation are a plate wall 195 and a flange wall 200 that are generally oriented parallel to each other. The plate and flange walls (195, 200) form a flange cavity 207 that is adapted to receive the middle flange of the inner corner connector. Located at the top of the plate wall 195 is an inward protrusion 205 that is configured to latch over the first inner plate. When the inward protrusion 205 is latched over the first inner plate, the bracket 160 is prevented from sliding downwards into the foaming cavity. Outward movement of the inward protrusion 205 is prevented by the outer foaming slat 185 pressing against the stringers. A horizontal landing 210 outwardly extends from the upper region of the flange wall 200 to a vertical rail wall 215. Similar to the plate wall 195, the rail wall 215 includes a hook 220 at the upper portion of the rail wall 215 that is configured to be secured to the top side rail. In the illustrated example, the plate wall 195 includes an inward protrusion 205 while the rail wall 215 includes a hook 220, however it should be appreciated that both walls (195, 215) could include hooks, both walls could include protrusions, or some other fastening device could be used to secure the walls (195, 215) to their respective plates or rails.

As shown in FIG. 6, the length of the horizontal landing 210 is approximately equal to the second substantially flat bottom of the inner corner connector 5. The spacing of the middle flange and the inner flange is approximately equal to the combined width of the first inner plate 105 (or side wall) and the plate wall 195. The inward protrusion 205 extends inward an amount that is approximately equal to the width of the first inner plate 105.

The top side rail 175 includes an apex 225 near the hook 220 of the bracket 160 that is configured to interact with the over rail 230 of the second panel (the roof in the illustrated example). As the horizontal roof panel is lowered down upon the vertical wall panel, the outermost portion of the over rail 230 extends over the apex 225 of the top side rail 175. If the two panels are not perfectly aligned during the joining process, the interaction of the over rail 230 and the top side rail 175 will cause the panels to rotated or move into proper alignment. As the roof panel is brought down, it compresses the inner corner connector 5 forming a thermal seal between the roof panel and the wall panel. In an exemplary embodiment, while the roof panel is pressing down to compress the inner corner connector, the bracket 160 is compressing the inner corner connector upwards as a result of the pressure exerted by the expanding foam within the foaming cavity. If the bracket has a degree of flexibility, the upward pressure from the foam will help to compensate for any variations (sags, deviations, etc.) in roof panels that could decrease the effectiveness of the seal formed by the inner corner connector.

It should be understood that the programs, processes, methods and system described herein are not related or limited to any particular type components unless indicated otherwise. Various combinations of general purpose, specialized or equivalent components may be used with or perform operations in accordance with the teachings described herein. In view of the wide variety of embodiments to which the principles of the present invention can be applied, it should be understood that the illustrated embodiments are exemplary only, and should not be taken as limiting the scope of the present invention. For example, more, fewer or equivalent elements may be used in the embodiments.

We claim:

1. An inner corner connector for an insulated cargo container with an interior, the inner corner connector comprising:

a horizontal base with a first side opposite a second side;

an inner flange
- secured to the first side and
- extending perpendicularly away from the horizontal base;

a center flange
- secured to the first side and
- extending away from the horizontal base;

a plurality of flexible flaps
- secured to the second side and
- extending away from
  - the horizontal base,
  - the inner flange, and
  - the center flange;

wherein an inner flap of the plurality of flexible flaps is secured to the second side, an outer flap of the plurality of flexible flaps is secured to the second side, the inner flap includes a first concave surface and a first convex surface, the outer flap includes a second concave surface and a second convex surface, and the first convex surface and the second convex surface are both located directly between the first concave surface and the second concave surface; and wherein a single piece of plastic forms the horizontal base, the inner flange, the center flange, and the plurality of flexible flaps, and the single piece of plastic has a first plasticizer concentration in the plurality of flexible flaps, a second plasticizer concentration in the horizontal base, the inner flange, and the center flange, and the first plasticizer concentration is greater than the second plasticizer concentration.

2. The inner corner connector of claim 1 wherein the center flange extends from the horizontal base towards the inner flange, a proximal portion of the center flange located proximal to the horizontal base is a first distance from the inner flange, a distal end of the inner flange is a second distance from the center flange and a third distance from the horizontal base, a distal foot region of the center flange is a fourth distance from the horizontal base, the second distance is less than the first distance, and the fourth distance is greater than the third distance.

3. The inner corner connector of claim 2 wherein the distal end of the inner flange is tapered.

4. The inner corner connector of claim 1 wherein the inner flange, the center flange, and a first bottom of the first side cooperate to form a cavity adapted to receive an interior wall plate of the cargo container and the center flange is configured to be deflected away from the inner flange to secure the interior wall plate in the cavity.

5. The inner corner connector of claim 1 wherein the inner flange includes an inner side, the horizontal base includes a outer side opposite and parallel to the inner side, the inner flap of the plurality of flexible flaps is secured to the second side adjacent the inner side, the outer flap of the plurality of flexible flaps is secured to the second side adjacent the outer side, and the horizontal base is more rigid than both the inner flap and the outer flap.

6. The inner corner connector of claim 1 further comprising a middle flap of the plurality of flexible flaps, the middle flap secured to the second side of the horizontal base and located between the first convex side and second convex side.

7. The inner corner connector of claim 1 wherein a distal foot region of the center flange is separated from a distal end of the inner flange;

at a portion of the center flange adjacent to the horizontal base, the center flange is located a first distance from the inner flange;

the center flange is separated from an outer side by a fifth distance; and the fifth distance is at least twice the first distance.

8. The inner corner connector of claim 1 wherein the inner corner connector has a height of approximately 2 inches.

9. The inner corner connector of claim 8 wherein the inner corner connector has a length of approximately 50 feet.

10. The inner corner connector of claim 1 wherein the inner flange extends a third distance perpendicularly away from the horizontal base;

the center flange extending a fourth distance away from the horizontal base; and the third distance does not equal the fourth distance.

11. The inner corner connector of claim 1 wherein the inner flap of the plurality of flexible flaps is secured to the second side at a first attachment point directly above the inner flange, a middle flap of the plurality of flexible flaps is secured to the second side at a second attachment point directly above the center flange.

12. The inner corner connector of claim 1 wherein the inner flap having a first proximal end at the horizontal base and a first distal end;

the outer flap having a second proximal end at the horizontal base and a second distal end;

the inner corner connector having an uninstalled state and an installed state;

in the uninstalled state the first proximal end is separated from the second proximal end by a first separation and the first distal end is separated from the second distal end by a second separation;

in the installed state the first proximal end is separated from the second proximal end by the first separation and the first distal end is separated from the second distal end by a third separation;

the second separation is less than the third separation.

13. The inner corner connector of claim 1 further comprising a middle flap of the plurality of flexible flaps;

wherein the second side of the horizontal base is flat, and the inner, outer, and middle flexible flaps extend from the second side.

14. The inner corner connector of claim 1 wherein the plurality of flexible flaps includes at least three flexible flaps.

15. The inner corner connector of claim 1 wherein the first side has a first flat bottom and a second flat bottom, the first flat bottom bounded by the center flange and the inner flange, and the second flat bottom is at least twice the size of the first flat bottom.

16. An inner corner connector for a container with an interior, the inner corner connector comprising:

a horizontal base with a first side opposite a second side;

an inner flange secured to the first side and extending perpendicularly away from the horizontal base;

a center flange secured to the first side and extending away from the horizontal base;

an inner flap and a middle flap, wherein each flap is secured to the second side, includes a concave surface and a convex surface, and extends away from the horizontal base, the inner flange, and the center flange, and the convex surfaces of the inner and middle flaps are located directly between the concave surfaces of the inner and middle flaps;

a single piece of plastic forms the horizontal base, the inner flange, the center flange, the inner flap, and the middle flap; and the single piece of plastic has a first plasticizer concentration in the inner flap and the middle flap, a second plasticizer concentration in the horizontal base, the inner flange, and the center flange, and the first plasticizer concentration is greater than the second plasticizer concentration.

17. The inner corner connector of claim 16 wherein a distal foot region of the center flange is separated from a distal end of the inner flange;

at a portion of the center flange adjacent to the horizontal base, the center flange is located a first distance from the inner flange;

the center flange is separated from an outer side by a fifth distance; and the fifth distance is at least twice the first distance.

18. The inner corner connector of claim 16 wherein the inner flap is secured to the second side at a first attachment point directly above the inner flange, the middle flap is secured to the second side at a second attachment point directly above the center flange.

* * * * *